US011232895B2

(12) United States Patent
Sato

(10) Patent No.: US 11,232,895 B2
(45) Date of Patent: Jan. 25, 2022

(54) COIL COMPONENT AND METHOD FOR MANUFACTURING COIL COMPONENT

(71) Applicant: Murata Manufacturing Co., Ltd., Kyoto-fu (JP)

(72) Inventor: Kousei Sato, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 583 days.

(21) Appl. No.: 15/878,022

(22) Filed: Jan. 23, 2018

(65) Prior Publication Data

US 2018/0218825 A1 Aug. 2, 2018

(30) Foreign Application Priority Data

Jan. 31, 2017 (JP) ..... JP2017-015399

(51) Int. Cl.

| | |
|---|---|
| ***H01F 27/255*** | (2006.01) |
| ***H01F 27/29*** | (2006.01) |
| ***H01F 27/28*** | (2006.01) |
| ***H01F 27/245*** | (2006.01) |
| ***H01F 41/02*** | (2006.01) |
| ***H01F 41/061*** | (2016.01) |

(Continued)

(52) U.S. Cl.

CPC ..... *H01F 27/255* (2013.01); *H01F 17/04* (2013.01); *H01F 27/245* (2013.01); *H01F 27/2823* (2013.01); *H01F 27/292* (2013.01); *H01F 41/0233* (2013.01); *H01F 41/061* (2016.01); *H01F 41/10* (2013.01); *H01F 2017/048* (2013.01)

(58) Field of Classification Search

CPC ..... H01F 27/292; H01F 27/255; H01F 2017/048; H01F 41/10

See application file for complete search history.

(56) References Cited

U.S. PATENT DOCUMENTS

2003/0214793 A1* 11/2003 Uchida ..... H01F 1/22 361/761
2005/0018382 A1* 1/2005 Takazawa ..... H01F 17/0013 361/321.2

(Continued)

FOREIGN PATENT DOCUMENTS

JP H11-067554 A 3/1999
JP 2005-159121 A 6/2005

(Continued)

*Primary Examiner* — Elvin G Enad
*Assistant Examiner* — Malcolm Barnes
(74) *Attorney, Agent, or Firm* — Studebaker & Brackett PC

(57) ABSTRACT

A coil component includes a magnetic section containing a resin material and a filler component containing a magnetic metal, a coil conductor embedded in the magnetic section, and outer plating electrodes electrically connected to the coil conductor. At least one end portion of the magnetic section has a concave indentation. The surface of the indentation is overlaid with a hydrophobic insulating film. The surface of the magnetic section except for the indentation and extended end surfaces of the coil conductor are overlaid with an insulating protective film. The magnetic section, the coil conductor, and the protective film form a component body. The outer electrodes are placed on both end portions of the component body that exclude the indentation.

23 Claims, 10 Drawing Sheets

(51) Int. Cl.
*H01F 41/10* (2006.01)
*H01F 17/04* (2006.01)

(56) References Cited

U.S. PATENT DOCUMENTS

2006/0014303 A1* 1/2006 Takazawa ..... H01F 17/0013 438/1
2012/0274432 A1* 11/2012 Jeong ..... H01F 17/0033 336/192
2013/0113593 A1* 5/2013 Jeong ..... H01F 17/0013 336/200
2013/0147591 A1* 6/2013 Kim ..... H01F 17/04 336/200
2013/0255071 A1* 10/2013 Muneuchi ..... H01F 41/02 29/605
2013/0293334 A1* 11/2013 Shin ..... H01F 1/26 336/192
2016/0012961 A1* 1/2016 Suzuki ..... H01F 27/2804 336/192
2016/0027569 A1* 1/2016 Inoue ..... H01F 17/0013 336/192
2016/0172110 A1* 6/2016 Otani ..... H01L 41/0472 361/301.4
2016/0217902 A1* 7/2016 Choi ..... H01F 17/0013
2016/0225517 A1* 8/2016 Choi ..... H01F 27/292
2016/0260535 A1* 9/2016 Kubota ..... H01F 17/0013
2017/0084385 A1* 3/2017 Ida ..... H01F 27/2852
2017/0309389 A1* 10/2017 Sato ..... H01F 27/29
2017/0330673 A1* 11/2017 Sato ..... H01F 27/29
2018/0061553 A1* 3/2018 Jeon ..... H01F 27/255
2018/0218825 A1* 8/2018 Sato ..... H01F 41/0233

FOREIGN PATENT DOCUMENTS

JP 2005159121 A * 6/2005
JP 2009-158662 A 7/2009
JP 2009158662 A * 7/2009
JP 2016-018885 A 2/2016

* cited by examiner

COIL COMPONENT AND METHOD FOR MANUFACTURING COIL COMPONENT

CROSS-REFERENCE TO RELATED APPLICATION

This application claims benefit of priority to Japanese Patent Application No. 2017-015399, filed Jan. 31, 2017, the entire content of which is incorporated herein by reference.

BACKGROUND

Technical Field

The present disclosure relates to coil components and methods for manufacturing the coil components. The present disclosure particularly relates to a coil component including a magnetic section containing a resin material and a filler component, such as a magnetic metal powder, dispersed in the resin material and a method for manufacturing the coil component.

Background Art

Hitherto, coil components including a magnetic section containing a resin material and a magnetic metal powder dispersed therein have been widely used in power inductors, transformers, and the like. This type of coil component includes an outer electrode that is formed in such a manner that a conductive paste obtained by dispersing a conductive powder in a thermosetting resin is applied to a surface of a component body and is cured at a relatively low temperature, because a resin material making up a magnetic section has poor heat resistance. However, since the conductive paste is used to form the outer electrode, the adhesion strength between the outer electrode and the component body may possibly decrease.

For example, Japanese Unexamined Patent Application Publication No. 2016-18885 (hereinafter referred to as the patent document) discloses an inductor component including a component body which has a substantially rectangular parallelepiped shape defined by a first principal surface, a second principal surface, a first side surface, a second side surface, a first end surface, and a second end surface. The first and second principal surfaces face each other, the first and second side surfaces face each other, and the first and second end surfaces face each other. The component body contains resin and filler dispersed in the resin. The inductor component further includes an inductor conductor placed in the component body, and an outer electrode which is electrically connected to the inductor conductor and which is placed on an outer surface of the component body. Omissions caused by the omission of the filler from the outer surface are scattered in a portion of the outer surface of the component body that is in contact with the outer electrode.

Typically, this type of coil component is prepared by a so-called multi-product manufacturing process from the viewpoint of ensuring good productivity. The term "multi-product manufacturing process", as used herein, refers to a process in which a collective board that is a cluster of magnetic sections in which inner conductors are embedded is prepared and is vertically and horizontally cut into pieces, thereby obtaining a large number of the magnetic sections from the single collective board.

In the patent document, a collective board is half-cut with a dicer and the omissions are formed by omitting the filler component from the component body surface, whereby the stress induced at the interface between the component body and the outer electrode is reduced. Furthermore, an attempt is made to increase the adhesion force of the outer electrode to the component body by increasing the contact area between the component body and the outer electrode.

However, in the patent document, a filler component is omitted. Therefore, as shown in FIG. 11, omissions 101 (concave indentations) are scattered on an end surface of a component body 102. Hence, in the case where outer electrodes 103 are formed by applying a conductive paste to both end portions of the component body 102 in this state, the omissions 101 are blocked, so that cavities 104 are caused between the component body 102 and the outer electrodes 103. Therefore, water may possibly remain in the cavities 104 in the course of manufacture.

In the case where soldering is performed by heating such as reflow heating in such a state that water remains in the cavities 104, the water in the cavities 104 evaporates to burst solder, that is, a phenomenon referred to as so-called "solder bursting" occurs. Solder burst by solder bursting may possibly adhere to a mounted component or a wiring board to cause a failure such as a short circuit. This is not preferable.

In this case, even if a sputtering process is used instead of an application process using a conductive paste, outer electrodes 105 are formed on both end portions of a component body 107 so as to follow the inner surfaces of omissions 106 as shown in FIG. 12. Therefore, sputtering materials may possibly adhere to each other in the vicinity of an opening 108 of each omission 106. Hence, the omissions 106 are blocked, so that cavities 109 are caused between the component body 107 and the outer electrodes 105. In the case of soldering by reflow heating or the like, solder bursting may possibly occur similarly to FIG. 11.

SUMMARY

The present disclosure has been made in view of the above circumstances. The present disclosure provides a coil component capable of suppressing the occurrence of solder bursting due to heating during soldering even in the case where concave indentations are scattered in an end portion of a component body. The present disclosure also provides a method for manufacturing the coil component.

According to preferred embodiments of the present disclosure, a coil component includes a magnetic section containing a resin material and a filler component, dispersed in the resin material, mainly containing a magnetic metal, a coil conductor embedded in the magnetic section, and outer electrodes electrically connected to the coil conductor. At least one end portion of the magnetic section has a concave indentation. The inner surface of the indentation is overlaid with a hydrophobic insulating film. Surfaces of the magnetic section that exclude the indentation and extended end surfaces of the coil conductor are overlaid with an insulating protective film. The magnetic section, the coil conductor, and the protective film form a component body. The outer electrodes are composed of plated coatings and are placed on both end portions of the component body that exclude the indentation.

In the coil component, the coil conductor is preferably an air-core coil with a substantially flat rectangular shape. In the coil component, the filler component preferably contains at least one selected from the group consisting of a glass material, a ferrite material, and a ceramic material. In the coil component, the plated coatings preferably have a multilayer structure.

According to preferred embodiments of the present disclosure, a method for manufacturing coil components includes a step of covering a magnetic metal with a hydrophobic insulating film, a step of preparing magnetic sheets in such a manner that slurry is prepared by wet-mixing a filler component mainly containing the magnetic metal with a resin material and is formed into sheets, and a collective board-preparing step of preparing a collective board in such a manner that a plurality of coil conductors two-dimensionally arranged are embedded in the magnetic sheets. The method also includes a step of dividing the collective board into pieces, surface-exposing extended end surfaces of the coil conductors, and obtaining magnetic sections each of which has a concave indentation formed in at least one end portion thereof. The method further includes a component body-preparing step of preparing component bodies by forming insulating protective films over surfaces of the magnetic sections that exclude the indentation and the extended end surfaces of the coil conductors, and a step of forming outer electrodes on both end portions of each component body that exclude the indentation by plating.

In the method, in the plating, it is preferable that conductive layers are formed on both end portions of each component body that exclude the indentation and one or more plated coatings are formed on a surface of each conductive layer by electroplating. In the method, in the collective board-preparing step, the coil conductors two-dimensionally arranged are preferably embedded in a multilayer body composed of the magnetic sheets.

In the method, in the component body-preparing step, the protective films are preferably prepared by contacting the magnetic sections with an emulsion solution containing an etching component and a resin component. In this case, the emulsion solution preferably further contains an etching accelerator and a surfactant.

A coil component according to an embodiment of the present disclosure includes a magnetic section containing a resin material and a filler component, dispersed in the resin material, mainly containing a magnetic metal, a coil conductor embedded in the magnetic section, and outer electrodes electrically connected to the coil conductor. At least one end portion of the magnetic section has a concave indentation. The inner surface of the indentation is overlaid with a hydrophobic insulating film. Surfaces of the magnetic section that exclude the indentation and extended end surfaces of the coil conductor are overlaid with an insulating protective film. The magnetic section, the coil conductor, and the protective film form a component body. The outer electrodes are composed of plated coatings and are placed on both end portions of the component body that exclude the indentation. Since the inner surface of the indentation is overlaid with the hydrophobic insulating film, the indentation repels a plating solution with the hydrophobic insulating film, even though plating is performed. As a result, the plated coatings, which form the outer electrodes, can be formed with no water adhering to or remaining in the indentation in such a state that the indentation is not blocked but is maintained open. Thus, even in the case of performing solder mounting by heating such as reflow heating, solder bursting does not occur and the coil component can be obtained so as to have good reliability.

A method for manufacturing coil components according to an embodiment of the present disclosure includes a step of covering a magnetic metal with a hydrophobic insulating film, a step of preparing magnetic sheets in such a manner that slurry is prepared by wet-mixing a filler component mainly containing the magnetic metal with a resin material and is formed into sheets, and a collective board-preparing step of preparing a collective board in such a manner that a plurality of coil conductors two-dimensionally arranged are embedded in the magnetic sheets. The method also includes a step of dividing the collective board into pieces, surface-exposing extended end surfaces of the coil conductors, and obtaining magnetic sections each of which has a concave indentation formed in at least one end portion thereof. The method further includes a component body-preparing step of preparing component bodies by forming insulating protective films over surfaces of the magnetic sections that exclude the indentation and the extended end surfaces of the coil conductors, and a step of forming outer electrodes on both end portions of each component body that exclude the indentation by plating. Therefore, even though magnetic metal particles fall out and the indentation is formed in an omission when the collective board is divided into pieces, the hydrophobic insulating film remains on the inner surface of the indentation because the magnetic metal is covered with the hydrophobic insulating. Thus, even though plating is performed thereafter, no water adheres to or remains in the indentation and the outer electrodes can be formed without blocking the indentation.

As described above, the indentation is not blocked and water can be inhibited from remaining. Therefore, even in the case of performing soldering by heating such as reflow heating, the occurrence of solder bursting can be suppressed. This allows the obtained coil component to have good reliability.

Other features, elements, characteristics and advantages of the present disclosure will become more apparent from the following detailed description of preferred embodiments of the present disclosure with reference to the attached drawings.

DESCRIPTION OF EMBODIMENTS

Embodiments of the present disclosure are described below in detail.

Figure 1:
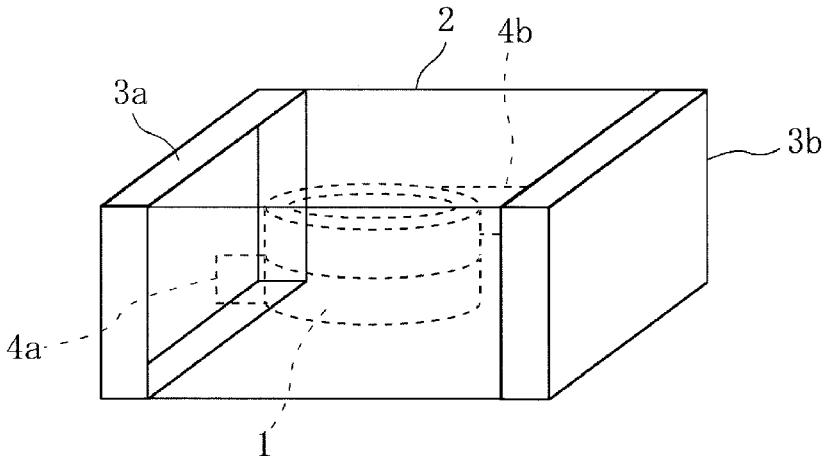
FIG. 1 is a schematic perspective view of a coil component according to an embodiment of the present disclosure.

FIG. 1 is a perspective view of a coil component according to an embodiment of the present disclosure. The coil component includes an air-core type of coil conductor 1 formed by spirally winding a flat wire, a component body 2 in which the coil conductor 1 is embedded, and outer electrodes 3*a* and 3*b*, placed on both end portions of the component body 2, composed of plated coatings.

In particular, the coil conductor 1 includes a conductive wire which is coated with an insulating resin such as a polyimide resin, a polyester resin, or a polyamideimide resin, which has a substantially flat strip shape, and which is spirally wound so as to have an air core. The coil conductor 1 includes an end portion 4*a* electrically connected to the outer electrode 3*a* and another end portion 4*b* electrically connected to the outer electrode 3*b*.

The conductive wire is not particularly limited and is preferably made of a material electrochemically nobler than Fe. Typically, Cu, which is inexpensive, can be preferably used to form the conductive wire. In this embodiment, a protective film is formed using the fact that metal particles are ionized in an emulsion solution as described below. The coil conductor 1 is electrically connected to the outer electrodes 3*a* and 3*b*. Therefore, it is avoided that extended end surfaces of the coil conductor 1 are covered with the protective film. From this viewpoint, the ionization of a metal used to form the conductive wire is preferably avoided. Therefore, a material, such as Cu, electrochemically nobler than Fe is preferably used to form the conductive wire.

Figure 2:
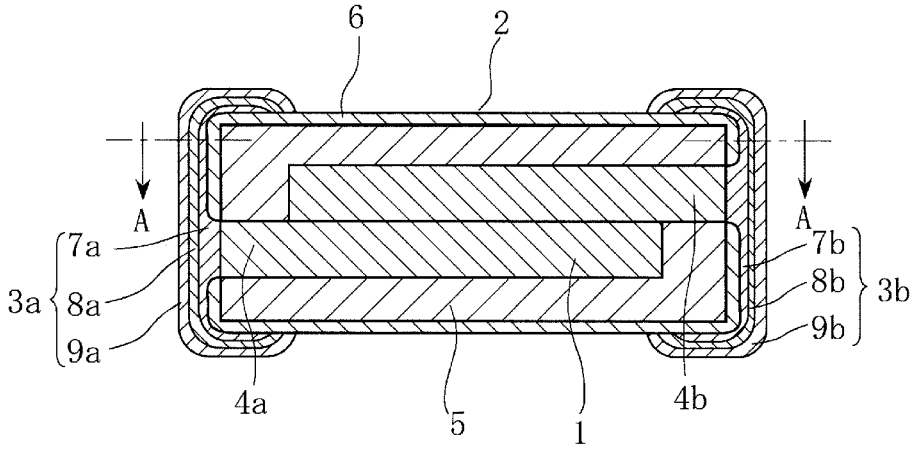
FIG. 2 is a vertical sectional view of FIG. 1.

FIG. 2 is a vertical sectional view of FIG. 1. The component body 2 includes a magnetic section 5 in which the coil conductor 1 is embedded and also includes an insulating protective film 6 placed on the magnetic section 5.

The outer electrode 3*a* has a multilayer structure composed of a first plated coating 7*a*, a second plated coating 8*a*, and a third plated coating 9*a*. The outer electrode 3*b* has a multilayer structure composed of a first plated coating 7*b*, a second plated coating 8*b*, and a third plated coating 9*b*. The first plated coatings 7*a* and 7*b* are made of, for example, a Cu-based material mainly containing Cu. The second plated coatings 8*a* and 8*b* are made of, for example, a Ni-based material mainly containing Ni. The third plated coatings 9*a* and 9*b* are made of, for example, a Sn-based material mainly containing Sn.

Figure 3:
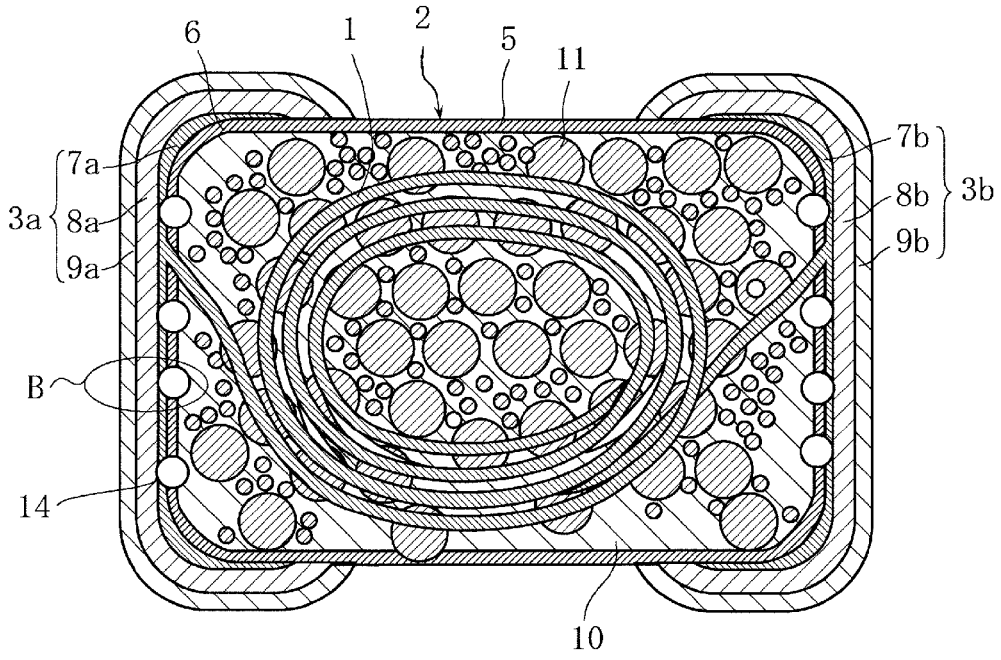
FIG. 3 is a sectional view taken along the line A-A of FIG. 2.

FIG. 3 is a sectional view taken along the line A-A of FIG. 2. The magnetic section 5 contains a resin material 10 that is a matrix and also contains a filler component 11, dispersed in the resin material 10, mainly containing a magnetic metal powder. The content of the filler component 11 in the magnetic section 5 is preferably about 60% by volume or more and more preferably about 60% by volume to 99% by volume. When the content of the filler component 11 is less than about 60% by volume, the content of the magnetic metal powder, which is a major component of the filler component 11, is extremely low, the magnetic permeability and the saturation magnetic flux density are low, and the reduction of magnetic characteristics may possibly be caused. The filler component 11, which mainly contains the magnetic metal powder (for example, about 60% by volume or more), may further contain, for example, a glass component, a ferrite powder, or the like.

As is clear from FIG. 3, the end portions 4*a* and 4*b* of the coil conductor 1 are electrically connected to the first plated coatings 7*a* and 7*b*, respectively. This ensures electrical continuity between the coil conductor 1 and the outer electrodes 3*a* and 3*b*.

Figure 4:
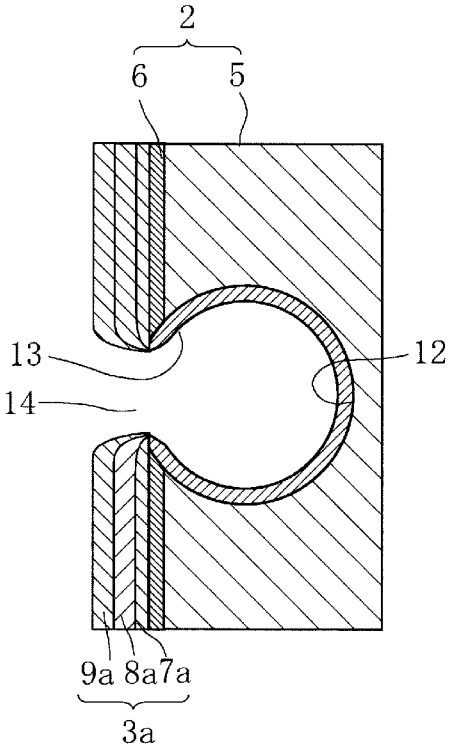
FIG. 4 is an enlarged view of Section B in FIG. 3.

FIG. 4 is an enlarged view of Section B in FIG. 3. Each concave indentation 12 extends from the interface between the component body 2 and the outer electrode 3*a* into the component body 2. The inner surface of the indentation 12 is overlaid with a hydrophobic insulating film 13. The indentation 12 is not blocked by the outer electrode 3*a* and has an opening 14 communicating with the outside.

In the case of a so-called multi-product manufacturing process in which a large number of coil components are obtained from a single large collective board by vertically and horizontally cutting the collective board, the indentations 12 are usually scattered in both end portions of the magnetic section 5 along a cutting line on the collective board. However, in this embodiment, the inner surfaces of the indentations 12 are overlaid with the hydrophobic insulating films 13 and therefore the indentations 12 are not blocked by forming the outer electrodes 3*a* and 3*b*, particularly the first plated coatings 7*a* and 7*b*. This avoids the occurrence of solder bursting.

The hydrophobic insulating films 13 are not particularly limited and may be made of a hydrophobic insulating material. For example, $Zn_3(PO_4)_2$, $SiO_2$, and glass materials such as borosilicate glass, alkali silicate glass, and quartz glass can be used to form the hydrophobic insulating films 13.

As described above, the coil component includes the magnetic section 5, which contains the resin material 10 and the filler component 11, dispersed in the resin material 10, mainly containing the magnetic metal powder; the coil conductor 1, which is embedded in the magnetic section 5 and is the air-core type; and the outer electrodes 3*a* and 3*b*, which are electrically connected to the coil conductor 1. The end portions of the magnetic section 5 have the indentations 12. The inner surfaces of the indentations 12 are overlaid with the hydrophobic insulating films 13. The protective film 6 is placed over surfaces of the magnetic section 5 that exclude the indentations 12 and the extended end surfaces of the coil conductor 1. The component body 2 is composed of the magnetic section 5, the coil conductor 1, and the protective film 6. The outer electrode 3*a* is composed of the first to third plated coatings 7*a* to 9*a*, the outer electrode 3*b* is composed of the first to third plated coatings 7*b* to 9*b*, and the outer electrodes 3*a* and 3*b* are placed on both end portions of the component body 2 that exclude the indentations 12. Therefore, the outer electrodes 3*a* and 3*b* can be formed by plating. Even though plating is performed, the indentations 12 repel a plating solution with the hydrophobic insulating films 13. As a result, the first to third plated coatings 7*a* to 9*a*, which form the outer electrode 3*a*, and the first to third plated coatings 7*b* to 9*b*, which form the outer electrode 3*b*, can be formed with no water adhering to or remaining in the indentations 12 in such a state that the indentations 12 are not blocked but are maintained open. Thus, even in the case of performing solder mounting by heating such as reflow heating, solder bursting does not occur and the coil component can be obtained so as to have good reliability.

A method for manufacturing the coil component is described below in detail.

Preparation of Magnetic Metal Powder

The magnetic metal powder is prepared. The magnetic metal powder is not particularly limited and may be, for example, a powder of an Fe-based soft magnetic material such as α-Fe, Fe—Si, Fe—Si—Cr, Fe—Si—Al, Fe—Ni, or Fe—Co. The morphology of the magnetic metal powder is not particularly limited. The magnetic metal powder is preferably amorphous because the magnetic metal powder has good soft magnetic characteristics. The magnetic metal powder may be crystalline.

The average particle size of the magnetic metal powder is not particularly limited and is preferably a mixture of two or more types of magnetic metal powders having different average particle sizes. The magnetic metal powder is dispersed in the resin material 10. Therefore, from the viewpoint of increasing the packing efficiency of the magnetic metal powder, the magnetic metal powder is preferably, for example, a mixture of magnetic metal powders, such as a magnetic metal powder having an average particle size of about 1 μm to 20 μm and a magnetic metal powder having an average particle size of about 10 μm to 40 μm, having different average particle sizes.

Formation of Hydrophobic Insulating Films

Figure 5:
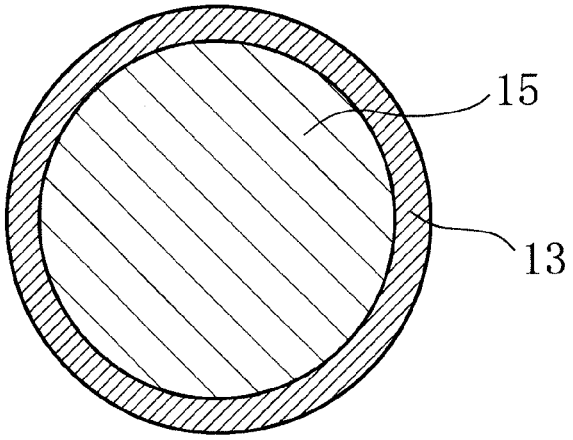
FIG. 5 is an illustration showing a state that a magnetic metal particle is covered with a hydrophobic insulating film.

As shown in FIG. 5, the surface of each of magnetic metal particles 15 contained in the magnetic metal powder is covered with a corresponding one of the hydrophobic insulating films 13. A process for forming the hydrophobic insulating films 13 is not particularly limited. For example, a sol-gel process, a mechanical technique, or the like can be used to form the hydrophobic insulating films 13. In the case of forming the hydrophobic insulating films 13 by the sol-gel process, sol (colloidal solution) obtained by dispersing the magnetic metal powder in an organic solvent such as ethanol is left stationary under sealed conditions, is thereby gelled, and is then crystallized by removing the organic solvent, hydroxy groups, alkoxide groups, and the like by heat treatment. This enables the hydrophobic insulating films 13 to be formed on the surfaces of the magnetic metal particles 15. In the case of forming the hydrophobic insulating films 13 by the mechanical technique, the hydrophobic insulating films 13 are formed in such a manner that hydrophobic insulating material particles are mechanically stuck to the surfaces of the magnetic metal particles 15 using a crusher such as a ball mill or particle hybridization is performed in such a manner that the magnetic metal particles 15 and the hydrophobic insulating material particles are charged into a rotary vessel and a mechanochemical reaction is caused by applying mechanical energy thereto. This enables the hydrophobic insulating films 13 to be formed on the surfaces of the magnetic metal particles 15. The thickness of the hydrophobic insulating films 13 is not particularly limited and is usually about 0.2 μm to 2 μm.

Preparation of Magnetic Sheets

Next, the resin material 10 is prepared. The resin material 10 is not particularly limited and may be, for example, an epoxy resin, a phenol resin, a polyester resin, a polyimide resin, a polyolefin resin, or the like.

Next, the magnetic metal particles 15 covered with the hydrophobic insulating films 13, the filler component 11 (a glass material, a ceramic powder, a ferrite powder, or the like), and the resin material 10 are wet-mixed into slurry. The slurry is formed into sheets by a doctor blade process or the like. The sheets are dried, whereby magnetic sheets which contain the resin material 10 and the filler component 11 dispersed therein and which has a thickness of about 100 μm to 300 μm are prepared.

Preparation of Collective Board

Next, the coil conductor 1 is prepared. The coil conductor 1 is composed of a flat wire, coated with a resin material, including a conductive wire made of Cu and has a substantially α-winding shape. The coil conductor 1 and other coil conductors identical to the coil conductor 1 are embedded in a multilayer body composed of the magnetic sheets, whereby a collective board is prepared.

Figure 6A:
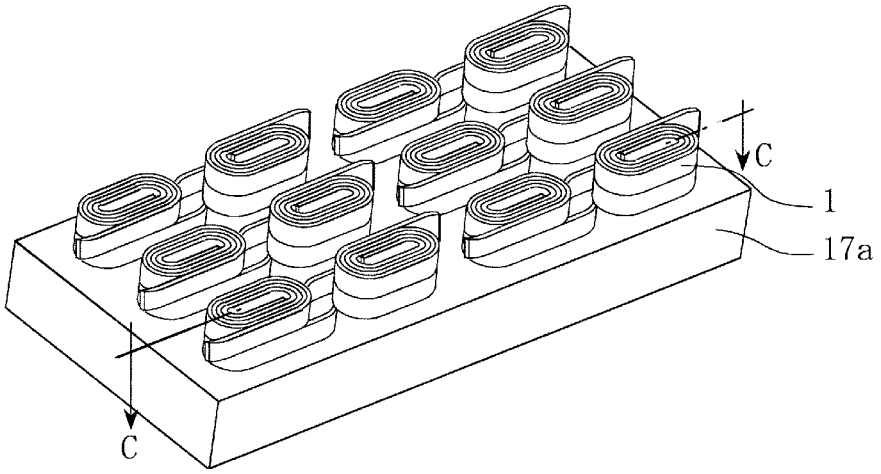
FIG. 6A is a perspective view showing an arrangement of coil conductors.
Figure 6B:
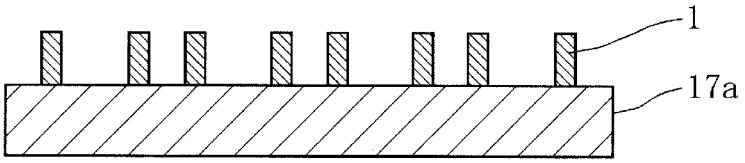
FIG. 6B is a sectional view taken along the line C-C of FIG. 6A.
Figure 7A:
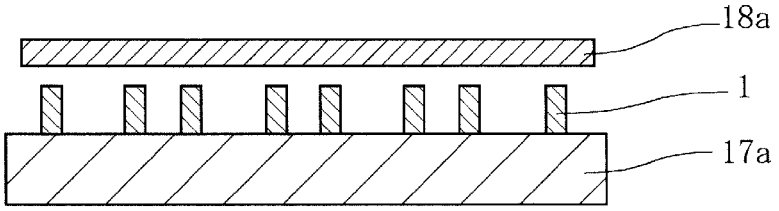
FIGS. 7A to 7D are illustrations showing steps of a process for preparing a collective board.
Figure 7B:
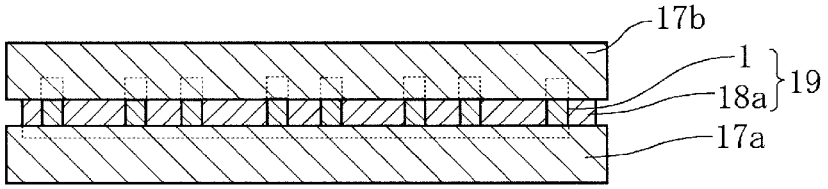
Figure 7C:
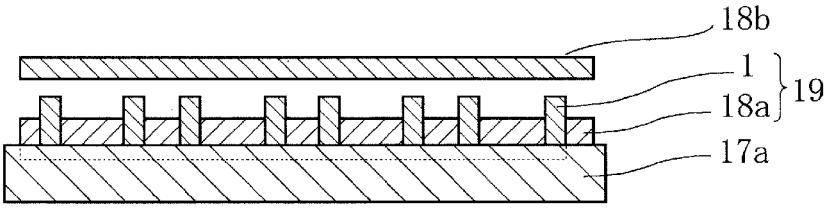
Figure 7D:
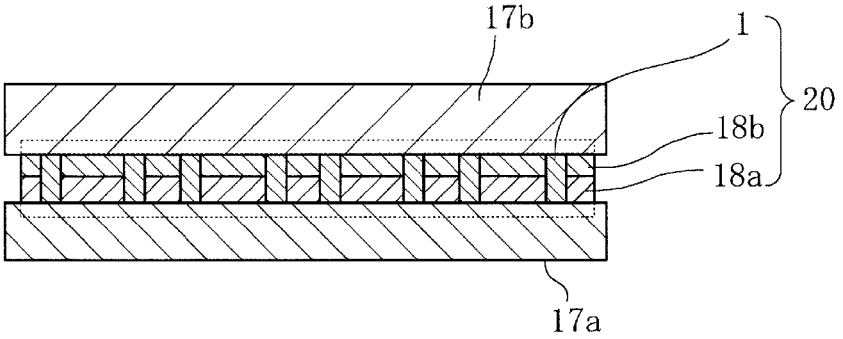

FIGS. 6A and 7D are illustrations showing an example of a process for preparing the collective board. FIG. 6A is a perspective view showing an arrangement of the coil conductor 1 and the other coil conductors. FIG. 6B is a sectional view taken along the line C-C of FIG. 6A. As shown in FIGS. 6A and 6B, a first die 17*a* is prepared and the coil conductor 1 and the other coil conductors are arranged on the first die 17*a* in a matrix pattern.

Next, as shown in FIG. 7A, a magnetic sheet 18*a* is provided on the coil conductor 1 and the other coil conductors. As shown in FIG. 7B, primary forming is performed by interposing the magnetic sheet 18*a* between the first die 17*a* and a second die 17*b*, whereby a primary form 19 in which the coil conductor 1 and the other coil conductors are partly embedded in the magnetic sheet 18*a* is prepared.

The second die 17*b* is separated from the primary form 19. As shown in FIG. 7C, another magnetic sheet 18*b* is provided on the primary form 19. As shown in FIG. 7D, secondary forming is performed in such a manner that the magnetic sheet 18*b* is interposed between the primary form 19 on the first die 17*a* and the second die 17*b*, followed by press forming, whereby a collective board (secondary form) 20 in which the coil conductor 1 and the other coil conductors are entirely embedded in the magnetic sheets 18*a* and 18*b*, that is, in a multilayer body composed of the magnetic sheets 18*a* and 18*b* is prepared.

Preparation of Magnetic Section 5

Figure 8:
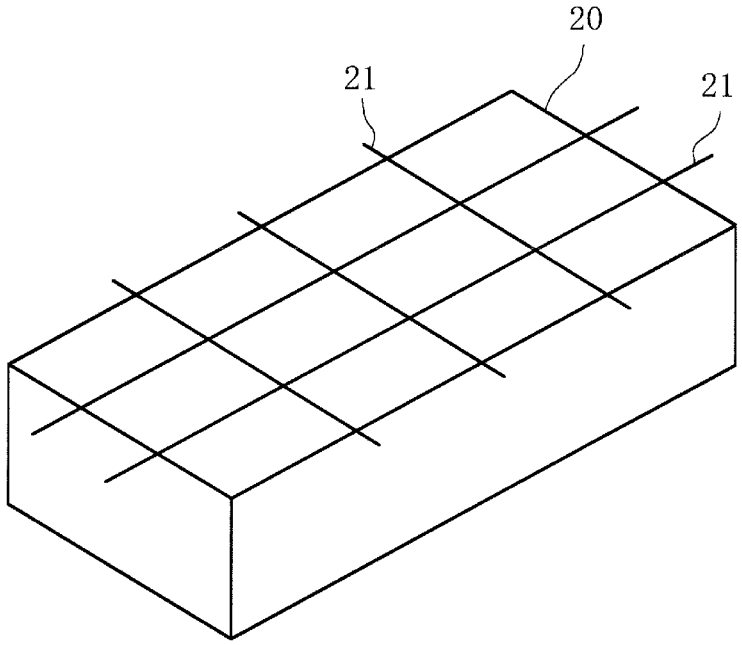
FIG. 8 is a perspective view of an example of the collective board.

As shown in FIG. 8, the collective board 20 is obtained by removing the first and second dies 17*a* and 17*b*. The collective board 20 is divided into pieces in such a manner that the collective board 20 is cut along cutting lines 21 using a cutting tool such as dicer, whereby the magnetic section 5 and other magnetic sections identical to the magnetic section 5 are prepared. In the magnetic section 5, the coil conductor 1 is embedded such that the extended end surfaces of the coil conductor 1 are surface-exposed. In this operation, the magnetic metal particles 15 present on the cutting lines 21 fall out of the magnetic section 5, whereby the indentations 12 are formed and the hydrophobic insulating films 13 are exposed on the inner surfaces of the indentations 12.

Formation of Component Body 2

The protective film 6 is formed over outer surfaces of the magnetic section 5 that exclude the surface-exposed hydrophobic insulating films 13 and the extended end surfaces of the coil conductor 1, whereby the component body 2 is prepared.

An emulsion solution is prepared by adding an etching accelerator and surfactant serving as additives to a system obtained by dispersing an etching component and a resin component in an aqueous solvent. The divided magnetic section 5 is immersed in the emulsion solution. An Fe component in the magnetic metal particles 15, which are contained in the magnetic section 5, is ionized by etching due to the action of the etching component. Fe ions produced by the ionization react with the resin component in the emulsion solution to form the protective film 6 on the magnetic section 5. The protective film 6 has a thickness of about 2 μm to 20 μm and is insulating. However, since Cu, which makes up the conductive wire of the coil conductor 1 surface-exposed on the end surfaces of the magnetic section 5, is electrochemically nobler than Fe, Cu is unlikely to be ionized and therefore does not react with the resin component in the emulsion solution. Likewise, the magnetic metal particles 15 do not react with the resin component in the emulsion solution because the inner surfaces of the indentations 12 are overlaid with the hydrophobic insulating films 13 and therefore the magnetic metal particles 15 are not surface-exposed. That is, portions excluding the extended end surfaces of the coil conductor 1 and the indentations 12 react with the resin component. This allows the protective film 6 to be formed over surfaces of the magnetic section 5 that exclude the extended end surfaces thereof and the indentations 12, whereby the component body 2 is formed.

The etching component used is not particularly limited and is preferably at least one selected from the group consisting of sulfuric acid, hydrofluoric acid, nitric acid, phosphoric acid, and acetic acid or a combination of some of these acids from the viewpoint of enhancing film-forming properties. The resin component used is not particularly limited and may be an acrylic-ester copolymer, an acrylonitrile-styrene-acrylic copolymer, a styrene-acrylic copolymer, acrylic silicone, an acrylic resin such as a methyl methacrylate resin, a polyimide resin, a silicone resin, a polyamideimide resin, a polyether ether ketone resin, a fluorinated resin, or the like. The aqueous solvent used is not particularly limited and may be, for example, pure water or a solvent mixture of pure water and various water-soluble organic solvents such as alcohols including methanol and ethanol, glycol ethers including ethylene glycol monoethyl ether, and ketones including methyl ethyl ketone.

From the viewpoint that the ionization of the magnetic metal powder is likely to proceed and the formation of the protective film 6 is promoted, the etching accelerator preferably contains an oxidizing agent. The oxidizing agent may preferably be, for example, hydrogen peroxide or a peroxodisulfate such as sodium peroxodisulfate. The etching accelerator need not be contained in the emulsion solution.

The surfactant used may be an anionic surfactant or a nonionic surfactant. If the surfactant is unlikely to be deactivated, then the protective film 6 is unlikely to be formed. However, if the surfactant is likely to be deactivated, then the emulsion solution is unstable. Therefore, the surfactant preferably has appropriate deactivation properties. From this viewpoint, the surfactant used is preferably an anionic surfactant such as a fatty acid salt such as sodium oleate, an alkyl sulfate such as sodium lauryl sulfate, an alkylbenzenesulfonate such as dodecylbenzenesulfonate, an alkylnaphthalenesulfonate, or an alkylsulfonate. In particular, a sulfo group-containing anionic surfactant such as an alkylbenzenesulfonate can appropriately control the degree of deactivation of the surfactant and therefore is more preferable.

The emulsion solution preferably contains iron fluoride as required. Iron fluoride is good in balancing the production of Fe ions by etching and the deactivation of the surfactant and contributes to uniformly forming the protective film 6.

Preparation of Outer Electrodes 3*a* and 3*b*

Figure 9A:
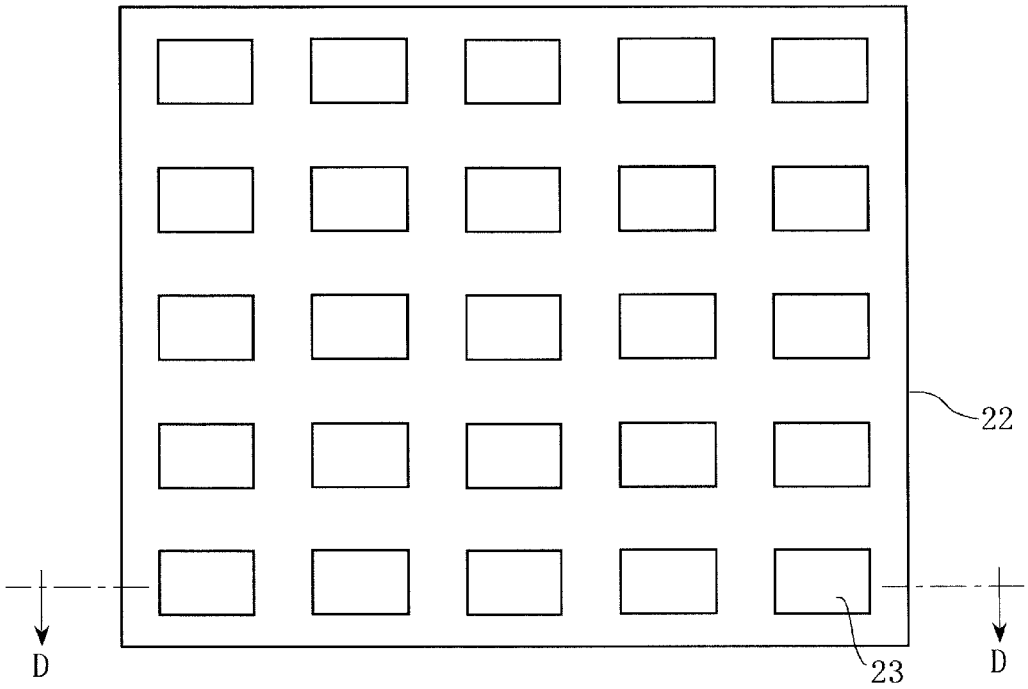
FIGS. 9A and 9B are illustrations showing steps of a process for preparing outer electrodes.
Figure 9B:
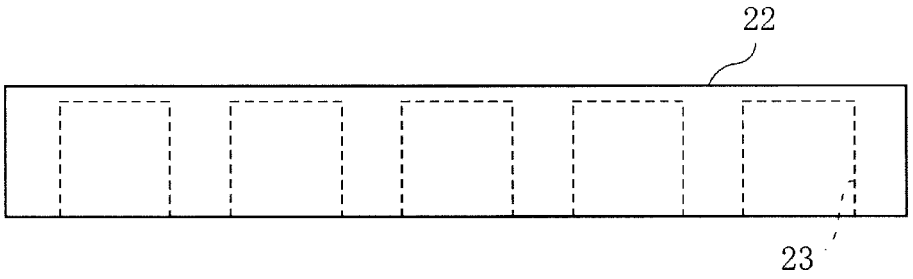

FIG. 9A is a plan view of a retainer 22 for retaining the component body 2. FIG. 9B is a sectional view taken along the line D-D of FIG. 9A.

As shown in FIGS. 9A and 9B, the retainer 22 has a large number of holes 23, arranged in a matrix pattern, capable of retaining the component body 2. After the component body 2 is chamfered by barrel polishing in water or air, the component body 2 is cleaned.

Figure 10A:
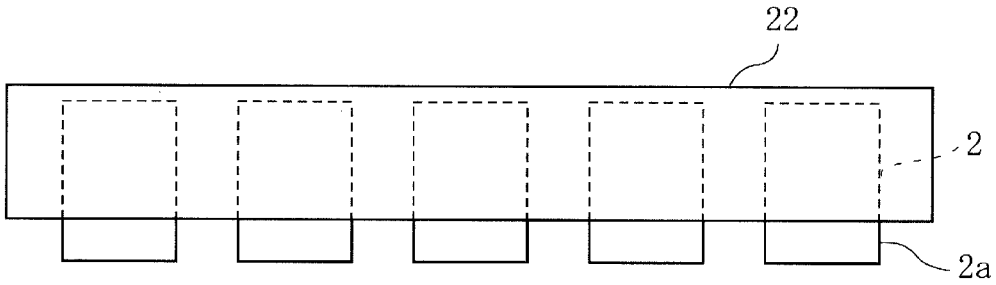
FIGS. 10A and 10B are illustrations showing steps of the process for preparing the outer electrodes.
Figure 10B:
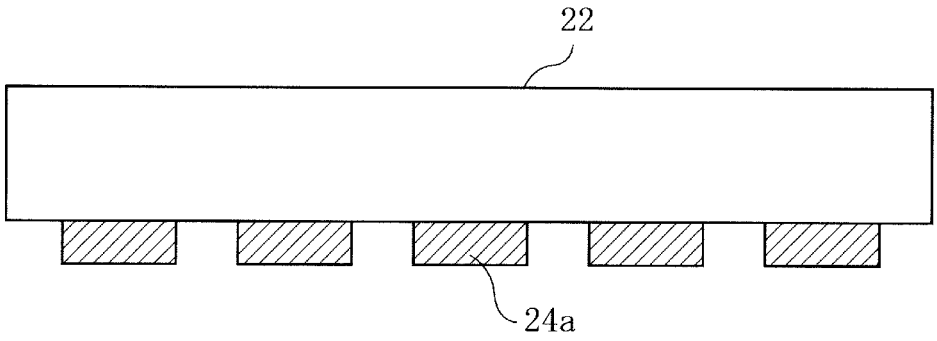
Figure 11:
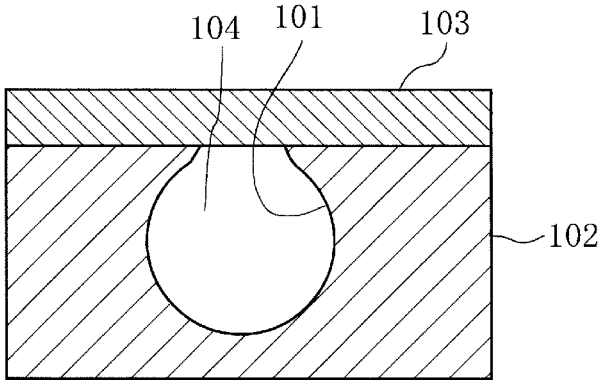
FIG. 11 is a substantial sectional view illustrating a problem in the case of forming an outer electrode using a conductive paste.
Figure 12:
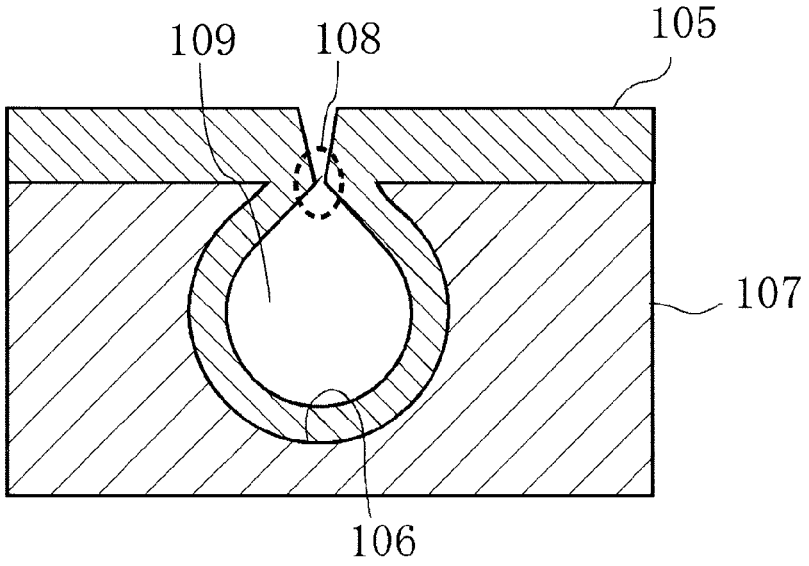
FIG. 12 is a substantial sectional view illustrating a problem in the case of forming an outer electrode by a sputtering process.

Next, as shown in FIG. 10A, the component body 2 and other component bodies identical to the component body 2 are retained in the holes 23 of the retainer 22 such that an end portion 2*a* of each of the component body 2 and the other component bodies protrudes from the retainer 22. The retainer 22 is immersed in a conducting solution, whereby a conductive layer 24*a* is formed on the end portion 2*a* as shown in FIG. 10B. A conductive material contained in the conducting solution is not particularly limited and may be one capable of forming a plated coating by electroplating below. The conductive material may be, for example, at least one selected from the group consisting of Pd, Sn, and Ag or an alloy mainly containing one or more of these metals.

Next, the component body 2 is taken out of the retainer 22. The component body 2 is retained with the retainer 22 such that another end portion 2*b* of the component body 2 protrudes from the retainer 22. The retainer 22 is similarly immersed in the conducting solution, whereby a conductive layer is formed on the end portion 2*b*.

Thereafter, the component body 2 is taken out of the retainer 22. The component body 2 is electroplated, whereby the first plated coatings 7*a* and 7*b* are prepared. Subsequently, the component body 2 is electroplated, whereby the second plated coatings 8*a* and 8*b* and third plated coatings 9*a* and 9*b* are prepared in that order, whereby the outer electrodes 3*a* and 3*b* are formed.

As described above, the method includes a step of covering the magnetic metal particles 15 with the hydrophobic insulating films 13, a step of preparing the magnetic sheets 18*a* and 18*b* in such a manner that slurry is prepared by wet-mixing the filler component 11, which mainly contain the magnetic metal particles 15, with the resin material 10 and is formed into sheets, and a step of preparing the collective board 20 in such a manner that the coil conductor 1 and the other coil conductors are two-dimensionally arranged and are embedded in the magnetic sheets 18*a* and 18*b*. The method also includes a step of dividing the collective board 20 into pieces, surface-exposing the extended end surfaces of the coil conductor 1, and obtaining the magnetic section 5 provided with the indentations 12 formed in the end portions thereof. The method further includes a step of preparing the component body 2 by forming the protective film 6 over surfaces of the magnetic section 5 that exclude the indentations 12 and the extended end surfaces of the coil conductor 1, and a step of forming the outer electrodes 3*a* and 3*b* on both end portions of the component body 2 that exclude the indentations 12 by plating. Therefore, even though the magnetic metal particles 15 fall out and the indentations 12 are formed in omissions when the collective board 20 is divided into pieces, the hydrophobic insulating films 13 remain on the inner surfaces of the indentations 12 because the magnetic metal particles 15 are covered with the hydrophobic insulating films 13. Thus, even though plating is performed thereafter, no water adheres to or remains in the indentations 12 and the outer electrodes 3*a* and 3*b* can be formed without blocking the indentations 12.

As described above, the indentations 12 are not blocked and water can be inhibited from remaining. Therefore, even in the case of performing soldering by heating such as reflow heating, the occurrence of solder bursting can be suppressed. This allows the obtained coil component to have good reliability.

The present disclosure is not limited to the above embodiment. In the above embodiment, for example, the flat wire is used in the coil conductor 1. This applies to a round wire and a rectangular wire. The indentations 12, which are caused by the fall of the magnetic metal particles 15, are formed along a cutting line. Therefore, the indentations 12 may possibly be formed in only one of the end portions of the magnetic section 5. It is needless to say that the present disclosure can be applied to this case. The thickness of the magnetic sheets 18*a* and 18*b* is determined depending on the average particle size of the magnetic metal powder. Therefore, when the average particle size of the magnetic metal powder is large, the coil conductor 1 may be embedded in a single magnetic sheet.

The procedure for forming the protective film 6 described in the above embodiment is an example and is not limited to the embodiment.

An example of the present disclosure is described below in detail.

EXAMPLE

Preparation of Sample

Amorphous soft magnetic particles corresponding to magnetic metal particles were prepared. The soft magnetic particles had a size of about 1 μm to 40 μm and mainly contain Fe—Si—Co.

Next, the surface of each of the soft magnetic particles was covered with a $SiO_2$ film (hydrophobic insulating film) with a thickness of about 1 μm by a sol-gel process using tetraethyl orthosilicate (TEOS) corresponding to a metal alkoxide. The soft magnetic particles covered with the $SiO_2$ films and an epoxy resin corresponding to a resin material were wet-mixed into slurry. The slurry was formed into magnetic sheets by a doctor blade process. The magnetic sheets had a length of about 140 mm, a width of about 140 mm, and a thickness of about 155 μm and contained the epoxy resin and the soft magnetic particles dispersed therein.

Next, coil conductors each including a conductive wire, made of Cu, coated with a polyimide resin were prepared so as to have a substantially α-wound air-core flat wire shape. The coil conductors had an air core having a substantially elliptical shape, an about 1.0 mm long major axis, and an about 0.3 mm long minor axis and also had a thickness of about 0.50 mm.

After the coil conductors were arranged on a first die so as to form a matrix with 94 rows and 60 columns, one of the magnetic sheets was provided on the coil conductors. The coil conductors and the magnetic sheet on the coil conductors were interposed between the first die and a second die and were press-molded, whereby a primary form was prepared. Next, the second die was separated from the primary form. Another one of the magnetic sheets was provided on the primary form. This magnetic sheet was interposed between the first die overlaid with the primary form and the second die and was press-molded, whereby a collective board (secondary form) was prepared.

The collective board was cut into pieces using a dicer, whereby magnetic sections in which the coil conductors were embedded were prepared. It was observed, using a scanning electron microscope (SEM), that the soft magnetic particles fell out of end portions of the magnetic sections to form indentations in which $SiO_2$ was surface-exposed.

The magnetic sections had a length of about 1.70 mm, a width of about 0.92 mm, and a thickness of about 0.92 mm Inside observation with the SEM showed that the distance between a side surface of each of the coil conductors and a surface of a corresponding one of the magnetic sections was about 0.08 mm.

Next, an emulsion solution was prepared. That is, the following materials were prepared: latex (Nipol SX1706A available from ZEON Corporation) having a polymer composition containing an acrylic-ester copolymer, 5 weight percent sulfuric acid corresponding to an etching component, pure water corresponding to an aqueous solvent, 30 weight percent aqueous hydrogen peroxide corresponding to an etching accelerator, and a sulfo group-containing anionic surfactant (ELEMINOL JS-2 available from Sanyo Chemical Industries, Ltd.). The latex, sulfuric acid, pure water, aqueous hydrogen peroxide, and the sulfo group-containing anionic surfactant were mixed at a ratio of 100:50:813:2:35 in terms of mL/L, whereby the emulsion solution was prepared. The divided magnetic sections were immersed in the emulsion solution and the acrylic-ester copolymer was allowed to react with the soft magnetic particles, whereby a protective film with a thickness of about 5 μm was formed over surfaces of each magnetic section that excluded the indentations, resulting in the preparation of a large number of component bodies.

After the component bodies were retained with a retainer such that an end portion of each component body protruded from the retainer, the retainer was immersed in a Pd solution (conducting solution), whereby a conductive layer was formed on the end portion of the component body. Likewise, a conductive layer was formed on another end portion of the component body. Next, both end portions of each of the component bodies were electroplated using a commercially available Cu plating bath so as to be electrically connectable to a corresponding one of the coil conductors, whereby a Cu coating (first plated coating) with a thickness of about 10 μm was formed on each of the end portions thereof.

Thereafter, a Ni coating (second plated coating) with a thickness of about 4 μm was similarly formed on the Cu coating by electroplating using a commercially available Ni plating bath. Finally, a Sn coating (third plated coatings) with a thickness of about 4 μm was similarly formed on the Ni coating by electroplating using a commercially available Sn plating bath, whereby outer electrodes were formed on both end portions of the component bodies, resulting in the preparation of example samples.

Furthermore, comparative samples were prepared in such a manner that no Cu coating (first plated coating) was formed by plating and a conductive paste was applied and was cured. That is, the conductive paste was prepared so as to contain an Ag powder and a thermosetting resin. The conductive paste was applied to both end portions of the untreated component bodies, followed by baking, whereby Ag coatings with a thickness of about 10 μm were formed. Thereafter, a Ni coating and a Sn coating were formed on each Ag coating in that order by substantially the same process and procedure as the above, whereby the comparative samples were prepared.

Evaluation of Samples

About 400 of the example samples and about 400 of the comparative samples were provided on a printed circuit board, were mounted thereon by reflow heating, and were observed for appearance with an optical microscope, whereby the example and comparative samples were evaluated. As a result, solder bursting occurred in about 40 of the about 400 comparative samples. However, solder bursting occurred in none of the example samples.

In the case of manufacturing coil components by a multi-product manufacturing process, the occurrence of solder bursting can be suppressed even though outer electrodes are formed in such a state that magnetic metal particles fall out of magnetic sections. The obtained coil components have good reliability.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a magnetic section containing a resin material and a filler component dispersed in the resin material, the filler component containing a magnetic metal particle;

a coil conductor embedded in the magnetic section, and end surfaces of the coil conductor being exposed from the magnetic section;

outer electrodes electrically connected to the coil conductor;

a concave indentation on at least one end of the magnetic section;

a hydrophobic insulating film covering a surface of the concave indentation; and an insulating protective film covering a surface of the magnetic section except for the indentation and not covering the end surfaces of the coil conductor, wherein the magnetic section, the coil conductor, and the protective film form a component body, and the outer electrodes are composed of plated coatings and are placed on both end portions of the component body that exclude the indentation.

2. The coil component according to claim 1, wherein the coil conductor is an air-core coil made of a flat rectangular wire.

3. The coil component according to claim 1, wherein the filler component further contains at least one selected from the group consisting of a glass material, a ferrite material, and a ceramic material.

4. The coil component according to claim 1, wherein the plated coatings have a multilayer structure.

5. The coil component according to claim 2, wherein the filler component further contains at least one selected from the group consisting of a glass material, a ferrite material, and a ceramic material.

6. The coil component according to claim 2, wherein the plated coatings have a multilayer structure.

7. The coil component according to claim 3, wherein the plated coatings have a multilayer structure.

8. The coil component according to claim 5, wherein the plated coatings have a multilayer structure.

9. A method for manufacturing coil components, comprising:

covering a magnetic metal particle with a hydrophobic insulating film;

dispersing a filler component containing the magnetic metal particle in a resin material to make a mixture;

forming the mixture into a magnetic sheet;

collective board-preparing by arranging a plurality of coil conductors two-dimensionally embedding the coil conductors in the magnetic sheet to make a collective board;

dividing the collective board into pieces in such a manner to expose end surfaces of the coil conductors from the pieces and to make a concave indentation on an end portion of at least one of the pieces to make magnetic section;

component body-preparing by forming an insulating protective film in such a manner to cover a surface of the magnetic section except for the indentation and not to cover end surfaces of the coil conductor to make a component body; and plating the component body to make outer electrodes on both end portions of the component body except for the indentation.

10. The method according to claim 9, wherein, in the plating, conductive layers on both end portions of the component body except for the indentation and then one or more plated coatings are formed on a surface of the conductive layer by electroplating.

11. The method according to claim 9, wherein, in the collective board-preparing, the coil conductors two-dimensionally arranged are embedded in a multilayer body composed of the magnetic sheets.

12. The method according to claim 9, wherein, in the component body-preparing, the protective film is prepared by contacting the magnetic section with an emulsion solution containing an etching component and a resin component.

13. The method according to claim 12, wherein the emulsion solution further contains an etching accelerator and a surfactant.

14. The method according to claim 10, wherein, in the collective board-preparing, the coil conductors two-dimensionally arranged are embedded in a multilayer body composed of the magnetic sheets.

15. The method according to claim 10, wherein, in the component body-preparing, the protective film is prepared by contacting the magnetic section with an emulsion solution containing an etching component and a resin component.

16. The method according to claim 11, wherein, in the component body-preparing, the protective film is prepared by contacting the magnetic section with an emulsion solution containing an etching component and a resin component.

17. The method according to claim 14, wherein, in the component body-preparing, the protective film is prepared by contacting the magnetic section with an emulsion solution containing an etching component and a resin component.

18. The method according to claim 15, wherein the emulsion solution further contains an etching accelerator and a surfactant.

19. The method according to claim 16, wherein the emulsion solution further contains an etching accelerator and a surfactant.

20. The method according to claim 17, wherein the emulsion solution further contains an etching accelerator and a surfactant.

21. A coil component comprising:

a magnetic section containing a resin material and a filler component dispersed in the resin material, the filler component containing a magnetic metal particle;

a coil conductor embedded in the magnetic section, and end surfaces of the coil conductor being exposed from the magnetic section;

outer electrodes electrically connected to the coil conductor;

a concave indentation on at least one end of the magnetic section;

a hydrophobic insulating film covering a surface of the concave indentation; and an insulating protective film covering a surface of the magnetic section except for the indentation and not covering the end surfaces of the coil conductor, wherein the magnetic section, the coil conductor, and the protective film form a component body, and the outer electrodes are composed of plated coatings and are placed on both end portions of the component body that exclude the indentation, and on the surface of the component body, the hydrophobic insulating film is formed only on an inner surface of the indentation.

22. The coil component according to claim 1, wherein the hydrophobic insulating film comprises at least one glass material.

23. The coil component according to claim 1, wherein the insulating protective film contains iron ions.

* * * * *